US006109825A

United States Patent [19]

Yon

[11] Patent Number: 6,109,825

[45] Date of Patent: Aug. 29, 2000

[54] PAVING APPARATUS WITH AUTOMATIC MOLD POSITIONING CONTROL SYSTEM

[75] Inventor: Anthony E. Yon, Gold Hill, N.C.

[73] Assignee: Power Curbers, Inc., Salisbury, N.C.

[21] Appl. No.: 09/320,234

[22] Filed: May 26, 1999

[51] Int. Cl.[7] ..... E01C 19/48

[52] U.S. Cl. ..... 404/84.05; 404/84.2; 404/84.8

[58] Field of Search ..... 404/84.05, 84.1, 404/84.2, 84.5, 84.8; 37/907

[56] References Cited

U.S. PATENT DOCUMENTS

| | | | |
|---|---|---|---|
| Re. 28,979 | 9/1976 | Long et al. . | |
| 3,029,715 | 4/1962 | Bowen . | |
| 3,175,478 | 3/1965 | Smith . | |
| 3,264,958 | 8/1966 | Babb et al. . | |
| 3,292,511 | 12/1966 | Cheney . | |
| 3,566,759 | 3/1971 | Gurries . | |
| 3,606,827 | 9/1971 | Miller et al. . | |
| 3,635,131 | 1/1972 | Larsen et al. . | |
| 3,637,026 | 1/1972 | Snow . | |
| 3,674,094 | 7/1972 | Kuntz . | |
| 3,709,116 | 1/1973 | Whitbread et al. . | |
| 3,710,695 | 1/1973 | Miller et al. . | |
| 3,749,504 | 7/1973 | Smith . | |
| 3,750,063 | 7/1973 | Lowen et al. . | |
| 3,771,892 | 11/1973 | Munyon et al. . | |
| 3,856,425 | 12/1974 | Miller et al. . | |
| 4,029,165 | 6/1977 | Miller et al. | 180/6.48 |
| 4,081,033 | 3/1978 | Bulger et al. . | |
| 4,197,032 | 4/1980 | Miller . | |
| 4,266,917 | 5/1981 | Godbersen . | |
| 4,319,859 | 3/1982 | Wise . | |
| 4,789,266 | 12/1988 | Clarke, Jr. et al. . | |
| 4,808,026 | 2/1989 | Clarke, Jr. et al. . | |
| 4,854,769 | 8/1989 | Fukukawa et al. . | |
| 4,861,189 | 8/1989 | Fukukawa et al. . | |
| 4,925,340 | 5/1990 | Heiser et al. . | |
| 4,948,292 | 8/1990 | Haven et al. . | |
| 5,044,820 | 9/1991 | Prang . | |
| 5,101,360 | 3/1992 | Bennett . | |
| 5,201,603 | 4/1993 | Bassett et al. . | |
| 5,356,238 | 10/1994 | Musil et al. . | |
| 5,362,176 | 11/1994 | Sovik . | |
| 5,401,115 | 3/1995 | Musil et al. . | |
| 5,549,412 | 8/1996 | Malone . | |
| 5,568,992 | 10/1996 | Grembowicz et al. . | |
| 5,599,134 | 2/1997 | Macku et al. . | |
| 5,662,431 | 9/1997 | Colvard . | |
| 5,941,658 | 8/1999 | Dahlinger et al. | 404/84.1 |

*Primary Examiner*—James A. Lisehora

*Attorney, Agent, or Firm*—Kennedy Covington Lobdell & Hickman, LLP

[57] ABSTRACT

An apparatus and method for automatically controlling operation of a slip form paver to maintain a substantially constant mold position relative to a string line while changing the cross slope of the mold. The paver follows a path over the ground relative to a string line using grade and steer sensors to detect changes in the vertical and horizontal distance of the mold relative to the string line. A slope sensor detects changes in cross slope of the mold. Piston-cylinder mechanisms responsive to signals from the steer, slope and grade sensors as used to position the mold relative to the string line. During changes in the cross slope of the mold as the paver travels, the control system periodically alters the null point of the steer sensor to offset for horizontal changes in mold position relative to the string line caused by changing the mold cross slope and periodically alters the null point of the grade sensors to offset for vertical changes in mold position relative to the string line caused by changing the mold cross slope. The magnitude of steer sensor offset is determined the vertical distance between the string line and a predetermined reference point on the mold and by the detected cross slope. The magnitude of grade sensor offset is determined by the horizontal distance between the string line and a predetermined reference point on the mold and by the detected cross slope.

17 Claims, 8 Drawing Sheets

PAVING APPARATUS WITH AUTOMATIC MOLD POSITIONING CONTROL SYSTEM

BACKGROUND OF THE INVENTION

1. Technical Field.

The present invention relates to self-propelled paving construction equipment and more particularly to slip form pavers in which flowable paving material is continually molded in a pre-determined cross-sectional shape along the ground and to a control system therefor.

2. Background Information.

Self-propelled slip form paving machines are generally well known and can be used to form curbs, gutters, spillways, sidewalks, troughs, barriers, and other continuous extrusions from concrete or other paving materials. These machines generally include a main frame supporting an operator station as well as the propulsion, hydraulic, and control systems. The main frame is often supported on tracked members by extendable/retractable posts. The main frame also supports a mold having a shape corresponding to the desired cross-sectional shape of the structure to be formed and a mold hopper for receiving paving material from a reservoir of paving material, which is often carried by a separate truck traveling adjacent to the paving apparatus. Paving material is often conveyed to the mold hopper by means of a rubber belt conveyor or spiral auger conveyor apparatus. Positioning of the mold during paving operations is usually accomplished by steering the tracked members and by extending or retracting the posts supporting the main frame, which changes the position of the main frame and therefore changes the position of the attached mold.

It is also known to automatically control movement of self-propelled slip form pavers using an external datum such as a string line and a plurality of sensors. A string line is carefully positioned using ground stakes, line rods, and line holders such that the string line is positioned at a known distance and elevation away from the desired location of the paved structure.

Once a string line has been prepared, the slip form paver can be positioned adjacent to the string line. A steer sensor, often consisting of a vertical wand attached to an electrical device that generates an electrical output signal proportional to the movement of the vertical wand away from a neutral or "null" position, is extended from the paver toward the string line such that the steer sensor wand is in contact with the string line and in the neutral position when the mold on the paver is in the desired location. A grade sensor, often consisting of a horizontal wand attached to an electrical device that generates an electrical output signal proportional to the movement of the horizontal wand away from a neutral or "null" position, is also extended from the paver to the string line such that the grade sensor wand is in contact with the string line and in the neutral position when the mold is in the desired position. Often, more than one grade or steer sensor is used on a given paver.

It should be noted that the term "grade" as used herein refers to change in level of the ground surface in the direction of paver travel. A paver traveling "uphill" therefore is traveling up a grade. On the other hand, the term "slope" as used herein refers to the change in ground level across the path of paver travel and is determined by the angle of the ground surface across the path of paver travel relative to an imaginary horizontal plane. A paver traveling over a slope, therefore, tilts in a direction transverse to the direction of paver travel. Both grade and slope are conventionally measured in terms of percentages. For example, a one foot vertical rise in ground level over a road 100 feet wide would result in a slope of one percent (1%).

Once the steer sensor and the grade sensor, or the multiple steer and grade sensors if more than one of each are used on a specific paver, are correctly positioned on the string line, then the slip form paver may be automatically made to travel along the string line using a control system in which signals from the steer sensor are used to adjust the steering of the paver and signals from the grade sensors are used to adjust the posts connecting the main frame to the tracked members on the side adjacent to the string line. Often, a front grade sensor attached to the forward part of the frame and a rear grade sensor attached to the rear portion of the frame relative to the direction of paver travel will be used. In this case, the front grade sensor signal is used to induce movement of the front grade post and the rear grade sensor signal is used to induce movement of the rear grade post.

While controlling a slip form paver using only steer and grade sensors may be adequate to automatically position a paved structure at a desired location on level ground, these sensors are generally inadequate to satisfactorily position the paved structure when the ground over which the paver travels is sloped. In recognition of this problem, it is known in the art to provide a slope sensor on slip form pavers. Typically, a slope sensor consists of a dampened pendulum that produces an electrical signal proportional to any deviation of the pendulum from a vertical orientation. The output signal from a slope sensor is often used to induce movement of the post or posts connecting the frame to the tracked members on the side of the frame opposite the string line, which are referred to as the "slope posts." When the paver travels over a path that slopes downward from left to right, when looking at the rear of the paving machine, then the slope sensor generates an output signal used to extend the slope post on the right side of the paver to return the paver frame, and thereby the mold, to a level position.

Automatic control of slip form pavers is therefore known in the art. Once the paver is correctly positioned relative to the string line, it can begin automatic paving operations using a combination of steer, grade and slope sensors. If the paver moves away from the string line in the horizontal direction, then this movement is detected by the steer sensor, which generates an output signal used to steer the paver back toward the string line. If the elevation of the forward or rear portions of the paver deviates relative to the elevation of the string line, then this deviation is detected by the forward or rear grade sensors, which transmit electrical signals used to extend or retract the forward or rear grade posts. If the paver travels over a sloped path, then the slope sensor generates an electrical signal used to extend or retract the slope post. Because the mold is attached to the paver frame, the position of the structure formed by the mold is determined by the position of the paver frame with respect to the string line.

It is also known in the art to form a paved structure having a cross slope relative to the slope of the ground surface on which the structure is formed. In this respect, the term "cross slope" refers to the transverse angle of the paving mold relative to the ground surface. For example, it is often desirable to form a curb and gutter structure in which the angle of the top surface of the gutter increases relative to the ground surface as the gutter extends away from the curb to form a so-called "catch angle." Conversely, it may be desirable for the angle of the top gutter surface to decrease as the gutter extends away from the curb to form a so-called "spill angle." If the mold is rigidly attached to the paver frame, then changing the transverse angle of the paver frame with respect to the ground changes the cross slope of the mold, and hence of the paved structure formed by the mold.

In conventional slip form pavers, it is known to use the slope post and a remote slope setpoint device to change the cross slope of a mold. A remote slope setpoint device, which is typically a handheld potentiometer, can be used to introduce an error signal into a conventional paver control system that corresponds to a desired mold cross slope. Upon receiving such an error signal, the paver control system extends or retracts the slope post until the signal received from the slope sensor matches the error signal generated by the remote slope setpoint device. After this point, automatic paver operations continue as described above and the slope sensor signal is used by the control system to maintain the desired mold cross slope as the ground slope changes.

But using a remote slope setpoint device and a conventional paver control system is problematic when changing the mold cross slope during paver operation to form a paving structure having a variable cross slope. This is because extending or retracting the slope post as the paver automatically guides on the string line to change the mold cross slope also changes of the position of the mold relative to the string line. Such a change in mold position when changing cross slopes in conventional control systems is often unacceptable because many paving projects have specifications requiring accuracy in mold placement plus or minus a fraction of an inch over ten linear feet, which is usually far less than the mold movement generated using a remote slope setpoint device and an existing paver control system as described above to form a paving structure having a variable cross slope. Accordingly, the mold position changes must be manually compensated for by either adjusting the grade and steer sensor mounting jacks or by calculating the amount of elevation and alignment error induced during mold cross slope transition and then incorporating corrections for the calculated error into the string line setup. These manual compensation methods are time consuming and often difficult to accurately perform.

As shown by the above discussion, what is needed in the art is an automatic control system for a paving apparatus that allows for the automatic forming of structures in which the cross slope can vary without changing the relative position of the slip formed structure to the string line. Moreover, the need is for such a control system to be effective on both level ground and on ground in which the slope changes as the paver travels along its intended path. Such a control device would ideally also accommodate the use of steer and grade sensors such that paving may be accomplished completely automatically using an external datum such as a string line.

BRIEF SUMMARY OF THE INVENTION

The present invention overcomes the problems encountered when changing mold cross slope during paving operations along a string line using conventional paver control systems by providing a paver and an automatic paver control system capable of maintaining a substantially constant relative position between a reference point on a mold and a string line while automatically changing the cross slope of the mold. The automatic control system includes a microcontroller that receives input signals from the grade, steer and slope sensors and generates output signals used to control movement of the slope and grade posts as well as steer the paver.

Before commencing paver operation, the paver is positioned such that the mold is in a desired position relative to the string line. An operator measures the horizontal and vertical distances between the string line and the point on the mold representing the back of curb and top of curb and enters these distances into the control system. The microcontroller uses these distances and the input received from the slope sensor to determine the change in relative horizontal and vertical distance between the mold reference point and the string line caused by changing the mold cross slope during paver operation along the string line. The microcontroller then alters the null point of the steer sensor an amount corresponding to and offsetting the deviation in relative horizontal distance caused by the change in cross slope and alters the null point of the grade sensors an amount corresponding to and offsetting the deviation in vertical distance caused by changing the mold cross slope. In this way, the automatic paver control system of present invention automatically maintains a substantially constant relative position between the mold reference point and the string line while changing the mold cross slope during paver operations.

The control system of the present invention also allows for the automatic transition from an initial mold cross slope to an altered mold cross slope over a predetermined distance while maintaining a substantially constant mold reference point position with respect to the string line. The microcontroller receives input from a pulse pick-up device to determine a speed and a linear advance of paver travel. A desired rate of slope change is calculated and the microcontroller generates output signals incrementally changing the mold cross slope to automatically achieve the altered mold cross slope over the predetermined distance. The control system also accommodates an operator changing the predetermined distance or the predetermined altered mold cross slope at any time during transition of the mold from the initial cross slope to the altered cross slope.

The present invention also provides a method of operating a self-propelled paving apparatus to automatically maintain a substantially constant relative position between a predetermined reference point on a paving mold and a string line while changing the mold cross slope from an initial cross slope to an altered cross slope as the paver travels over a ground surface using a string line and null-seeking steer and grade sensors. The method includes the steps of continuously detecting the cross slope of the mold during paver travel over the ground, periodically determining the change in the horizontal and vertical distance between the mold reference point and the string line caused by changing the mold cross slope, altering each grade sensor null point an amount corresponding to and offsetting the determined change in vertical distance between the mold reference point and the string line, and altering the steer sensor null point an amount corresponding to and offsetting the determined change in horizontal distance between the mold reference point and the string line. The amount of grade sensor null point alteration is determined using the horizontal mold distance and the detected mold cross slope and the amount of steer sensor null point alteration is determined using the vertical mold distance and the detected mold cross slope.

Using the apparatus and method of the present invention, it is therefore possible to automatically change the mold cross slope in a paving apparatus during paver travel and maintain a constant mold reference position without having to manually adjust the steer and grade sensor jacks or having to compensate for the mold cross slope transition when setting up the string line. An operator need only correctly position the paving apparatus of the present invention along a string line and input the horizontal and vertical mold distances into the control system. The paver can thereafter automatically conduct paving operations including maintaining a constant mold reference point while automatically changing the mold cross slope. These and other advantages of the present invention will become apparent upon reading the following detailed description and appended claims, and upon reference to the accompanying drawings.

BRIEF DESCRIPTION OF THE DRAWINGS

For a more complete understanding of this invention reference should now be had to the embodiments illustrated in greater detail in the accompanying drawings and described below. In the drawings, which are not necessarily to scale.

DETAILED DESCRIPTION OF THE INVENTION

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. It will be understood that all alternatives, modifications, and equivalents are intended be included within the spirit and scope of the invention as defined by the appended claims.

Figure 1:
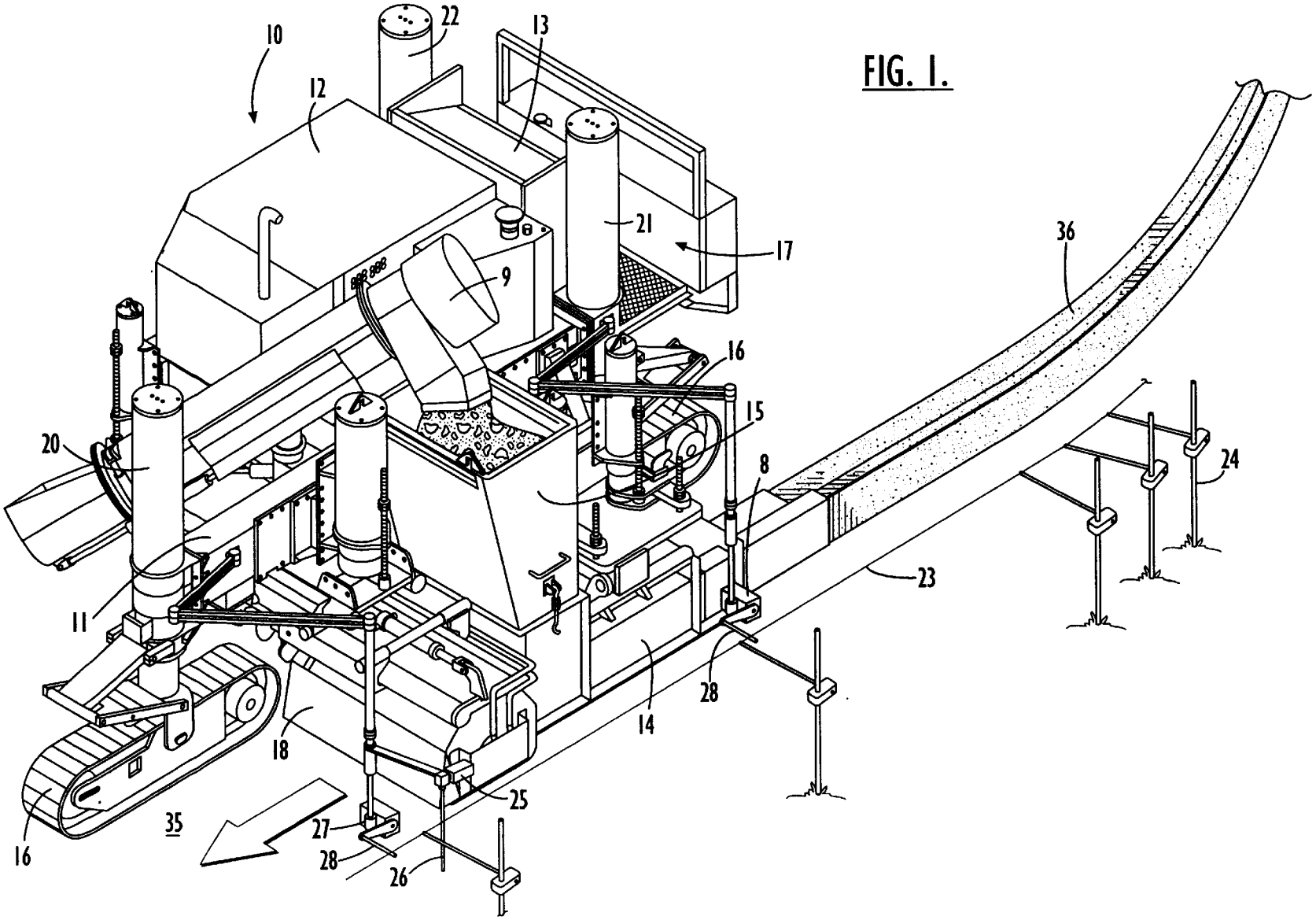
FIG. 1 is a perspective view of a slip form paving apparatus in accordance with a preferred embodiment of the present invention.

Turning now to the accompanying drawings and initially to FIG. 1, a self-propelled slip-form paving apparatus in accordance with the present invention is indicated in its totality at 10. The paving apparatus 10 is illustrated in FIG. 1 traveling over a ground surface 35 in the direction indicated by the arrow. The paving apparatus 10 comprises a main frame 11 supported substantially horizontally on a plurality of ground engaging members 16. The engaging members 16 are preferably endless track crawler assemblies but may be any other suitable engaging members such as wheel assemblies. Preferably, a single front ground engaging member 16, which is steerable, and a pair of rear ground engaging members are mounted to the main frame 11 in a triangular relation to each other to provide stable suspension of the frame 11 in a substantially horizontal position above the ground surface 35, although only two such ground engaging members are shown in FIG. 1.

An engine 12 or other suitable self-contained power generating machinery and a hydraulic pump (not shown) are mounted on the frame 11 to provide drive power to at least one ground engaging member 16 and to supply operational power to the various paver systems. The driven ground engaging member or members are preferably driven through individual hydraulic motors on each driven ground engaging member, although those skilled in the art will recognize that other suitable means may be used to drive the ground engaging members. It should be noted that the hydraulic motor associated with each driven ground engaging member is reversible and hence the paver may be operated while travelling in the forward or in the reverse direction. The paver 10 includes an operator station 17 in which the operator of the paving apparatus 10 is positioned and may monitor and control the paving apparatus using a control console 13.

The paver may optionally be equipped with a trimming station 18 in order to provide a finished grade of the ground surface immediately in advance of the paving operation. Such a trimming structure 18 may include a rotatively driven roller having digging teeth projecting from its outer periphery for the purpose of partially digging into the ground surface to loosen and uniformly distribute the soil on which the pavement is to be formed. The trimming station 18 may additionally include a scraper blade extending transversely across the rear side of the digging roller to level the loosened soil. The trimming station may be of the type described and illustrated in U.S. Pat. No. 4,808,026 to Clarke, Jr. et al. or U.S. Pat. No. 4,197,032 to Miller.

A mold 14 having a desired cross sectional shape corresponding to the cross sectional shape of the structure to be formed is supported by the frame 11. The mold 14 is located rearwardly of the trimming station 18 if such a trimming station is installed on the paving apparatus. In the present application, a mold in the shape of a curb and gutter structure is illustrated and the mold 14 is positioned on one side of the paving apparatus 10 to facilitate continuous slip forming of a concrete curb and gutter such as are typically formed along the sides of a roadway during road construction. It should be understood, however, that the paving apparatus of the present invention is capable of continually depositing concrete or other flowable paving material in a variety of different predetermined cross sectional shapes defined by a variety of different mold structures transported at a variety of different positions on the paving apparatus. Hence, it should be understood that the present invention is not limited to curb paving machines but is equally applicable to machines for slip forming roadways, gutters, spillways, sidewalks, troughs, barriers, and any other form of continuous paving extrusion.

The paving apparatus 10 of the present invention also includes a hopper 15 and a conveyor 9. Together, the conveyor and hopper are adapted to receive concrete or other flowable paving material from a separate paving material supply (not shown) and convey the flowable paving material to the mold 14. As is known in the art, means for vibrating the flowable paving material may be provided on the paving apparatus to eliminate air bubbles and facilitate flow of paving material into the mold 14. Flowable paving material is continuously supplied to the mold 14 such that a continuous paving structure 36 is formed on the ground surface 35 as the paving apparatus 10 moves along the ground.

As will be understood, the ground surface 35 on which the paving structure 36 is to be laid in molded form is prepared in advance by suitable construction grading equipment. During such preparations, it is common practice to construct an external datum from which the position of the curb or other paving structure can be determined. Typically, the external datum used consists of a string line 23 supported by a plurality of stakes 24 and line holders. Using an external datum such as a string line is advantageous because paver operations may be automatically controlled using various sensors for determining the position of the paver relative to the string line 23.

Specifically, the paving apparatus 10 may be provided with a steer sensor 25, front grade sensor 27, rear grade sensor 8, and a slope sensor 29 (not shown in FIG. 1). The steer sensor and grade sensors are neutral or "null" seeking and may be either a contact type sensors having a wand contacting the string line or non-contact type sensors such as those using ultrasonic ranging or other non-contact sensing technologies. A suitable sensor for use in the present invention as a steer sensor or as a grade sensor is manufactured and available from Sauer-Sundstrand Company under model number MCX103A1131. This sensor is a so-called "Hall effect" sensor, but those in the art will appreciate that other sensors such as potentiometer-type sensors may also be used. As illustrated in FIG. 1, the steer sensor 25 includes a steer sensor wand 26 and the front and rear grade sensors 27, 8 include grade sensor wands 28. It should be noted that the steer and grade sensors may be mounted on the paver in a manner that allows the sensors to be horizontally and vertically adjustable relative to the paving apparatus. The mounting apparatus used, however, should allow for the position of the steer and grade sensors to be fixed relative to the paver during paving operations.

The paving apparatus 10 is positioned on the ground surface 35 upon which the paving structure is to be laid in a such manner that the mold 14 is located relative to the string line 23 in the position that the paving structure is desired to be laid. The steer sensor wand 26 and grade sensor wands 28 are in contact with the string line 23 such that the wands are tangent to the string line and therefore the string line does not exert enough force on the wands to deflect them from their neutral or null position. It should be noted that use of two grade sensors is preferred, one on the front of the frame and one on the rear of the frame. Each grade and steer sensor produces an electrical output signal in proportion to the deflection of its respective wand from the neutral or null position. Preferably, a slope sensor 29 is located on the paving apparatus 10 to detect changes in cross slope as the apparatus travels over the ground and to generate an output signal proportional to the change in cross slope detected. Typically, slope sensors are of the dampened pendulum type and a suitable slope sensor for use in the present invention is available from Sauer-Sundstrand Company under the model number MCX104A1018.

The main frame 11 of the paving apparatus 10 is supported on the ground engaging members 16 by a plurality of posts, which are independently extendable or retractable to vary the position of the main frame with respect to the ground engaging members. Because the mold 14 is supported by the main frame, changing the position of the frame changes the position of the mold as well. The posts may be threaded posts that are rotated by associated reversible hydraulic motors or, alternatively, the posts may be operated by hydraulic piston-cylinder mechanisms. Three such piston-cylinder mechanisms are illustrated in FIG. 1, including a front grade piston-cylinder mechanism 20, a rear grade piston-cylinder mechanism 21, and a slope piston-cylinder mechanism 22. In addition to extending or retracting in a generally vertical direction, it should be understood that the front grade piston-cylinder mechanism 20 illustrated in FIG. 1 is supported by a ground engaging member 16 that includes a hydraulically operated steering mechanism, which may be a piston-cylinder mechanism or a hydraulically operated threaded post mechanism, that rotates the ground engaging member relative to the front grade piston-cylinder mechanism 20 to thereby steer the paving apparatus.

Automatic paving operation may be conducted using the sensors and piston-cylinder mechanisms described above. After the paving apparatus 10 and sensors are correctly positioned relative to the string line 23, paver travel and paving operations may commence. When deviations in the horizontal direction of paver travel are detected by the steer sensor 25, the steer sensor generates an output signal used to operate a steering servo valve, which directs hydraulic fluid to the appropriate port on the steering mechanism in order to turn the steerable ground engaging member in the direction required to return the steer sensor wand 26 to its neutral or null position. A suitable steering servo valve for use in the present invention is available from Sauer-Sundstrand Company under model number KVFBA6216.

Similarly, deviations in the vertical direction of the main frame relative to the string line are detected by the forward and rear grade sensors 27, 8 each of which generate an output signal used to control a servo valve associated with the front grade piston-cylinder mechanism 20 and the rear grade piston-cylinder mechanism 21, respectively. The piston-cylinder servo valves control extension or retraction of their associated piston-cylinder mechanisms to return the frame 11 to a position in which the forward and rear grade sensors are in their null position. Suitable servo valves for operation of the piston-cylinder mechanisms are available from Sauer-Sundstrand Company under the model number KVFBA5210.

Changes in mold cross slope as the paver travels are detected by the slope sensor 29, which generates an output signal used to control a servo valve associated with the slope piston-cylinder mechanism 22, located on the opposite side of the frame 11 as the string line 23. Extension or retraction of the slope piston-cylinder mechanism 22 is used to change the position of one side of the frame 11 in order to compensate for changes in ground slope or to induce a desired cross slope on the mold. Those in the art will appreciate that while only one slope piston-cylinder mechanism is shown in FIG. 1, additional slope posts or piston-cylinder mechanisms may also be used.

Typically, a pulse pickup device (not shown) is installed on the hydraulic motor of a driven ground engaging member 16 to generate a signal used to a determine distance of paver travel and a speed of paver travel. Use of pulse pickup devices for this purpose is known in the art, and a suitable pulse pickup device for use in the present invention is available from Electro Corporation under the model number DZH260-20.

To the extent thus far described, the structure and operation of the paving apparatus is essentially conventional. Indeed, slip form paving operations in which the position of the mold is automatically adjusted relative to an external datum using the plurality of frame-supporting posts and sensors described above provides a suitable finished paved structure in many applications.

In some applications, however, the conventional automatic paver control system described above does not produce satisfactory results. More specifically, conventional control systems for slip form pavers fail to satisfactorily control the mold position during paving operations in which it is desired to change the cross slope of the mold as the paver travels along the string line to thereby produce a paved structure having a variable cross slope. As previously discussed, the term "cross slope" refers to the transverse angle of the mold 14 with respect to the ground surface 35 over which the mold travels. Therefore, as used herein, the paving apparatus 10 travels along a ground surface 35 that has a slope and the paving apparatus is capable of positioning the mold with respect to the ground surface such that the mold itself has a cross slope. The value or angle of the cross slope for a particular mold is the value of the angle formed between the ground surface 35 and an imaginary reference plane 44 (see FIGS. 2–4) enclosing the bottom of the mold, when viewed in the transverse direction relative to the direction of paver travel. Whenever it is desired to extrude a paving structure having a transverse angle equal to the slope of the ground surface, then there would be no cross slope on the mold for used to form the given structure. In other words, the mold would be level relative to the ground surface.

There are many applications in which it is desirable to form a paving structure having a cross slope that is different from the slope of the ground surface onto which the structure is laid. For example, it is often desirable when making gutters or curb and gutter structures to form the gutter pan with either a "catch" or "spill" angle as previously described. Heretofore, transitioning between an initial mold cross slope and a desired or altered mold cross slope during paver travel along the string line was extremely difficult to correctly accomplish. An operator could change the mold cross slope by using a remote slope setpoint device as discussed above; however, when the control system extended or retracted the slope post to establish the desired cross slope, the extension or retraction of the slope post also changed the mold position relative to the string line. This change had to then be manually compensated for by either adjusting the grade and steer sensor mounting jacks or by calculating the amount of elevation and alignment error induced during transition of the mold and then incorporating corrections for the calculated error into the string line setup.

Figure 2:
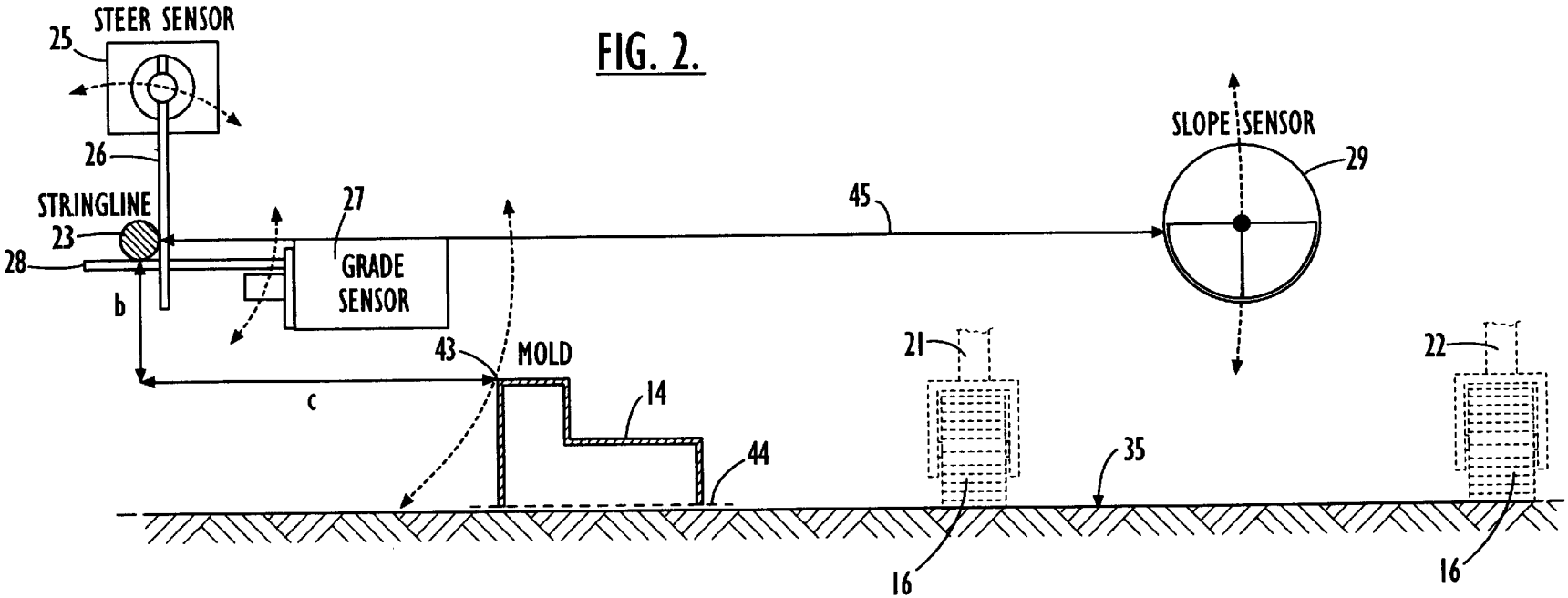
FIG. 2 is a schematic diagram illustrating the relationship between a level mold, a string line, and the control system sensors.
Figure 3:
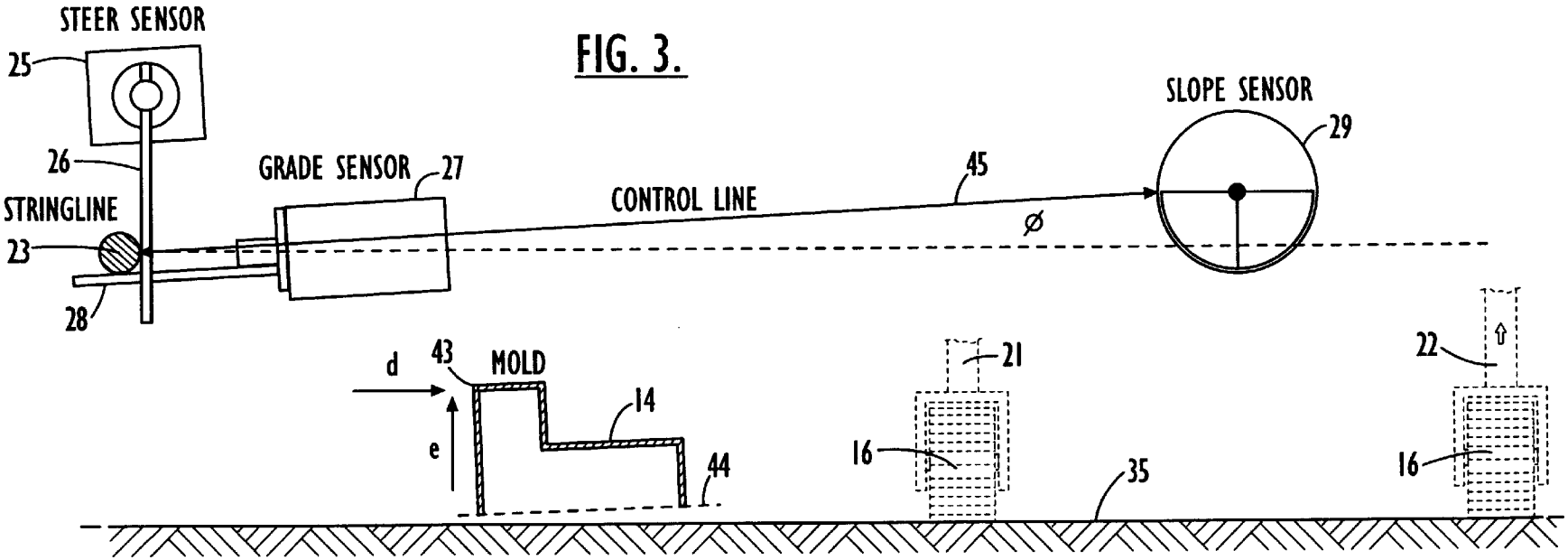
FIG. 3 is a schematic diagram similar to FIG. 2 illustrating the relationship between a mold having a cross slope, a string line, and the control system sensors.
Figure 4:
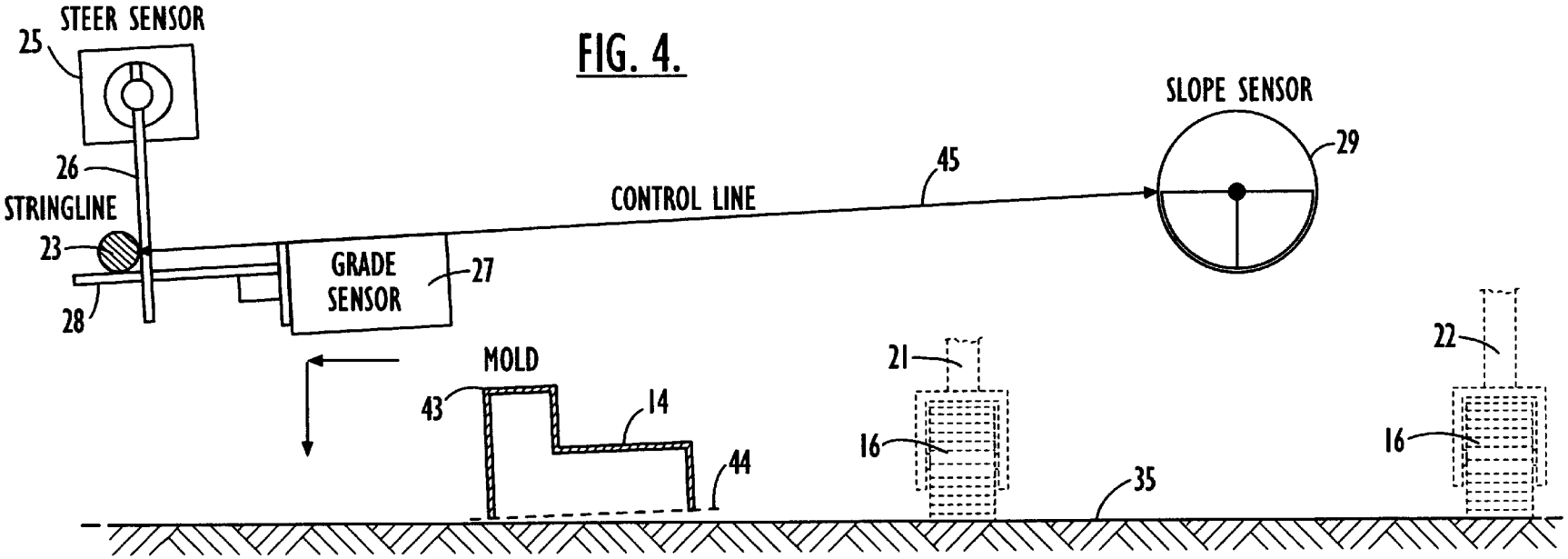
FIG. 4 is a schematic diagram similar to FIG. 3 illustrating the relationship between a mold, a string line, and the control system sensors after a conventional paver control system has corrected the mold position in response to a cross slope induced thereon.

The problem of mold placement error when transitioning between different mold cross slopes during paver travel using conventional paver control systems is schematically illustrated in FIGS. 2–4. FIG. 2 illustrates the relationship between the control sensors, the string line, and the mold in a paving operation in which the ground surface 35 has zero slope and in which there is no cross slope on the mold 14. The steer sensor wand 26 and the grade sensor wand 28 are in contact with the string line 23 and the mold 14 is adjacent the ground surface 35 in a position relative to the string line in which it is desired to form a curb and gutter structure. An imaginary control line 45 extends between the string line 23 and the slope sensor 29. It should be noted that the slope sensor 29 is schematically illustrated in FIGS. 2–4. These illustrations do not therefore attempt to show the position of the pendulum in the slope sensor at a given time.

The desired location of the mold 14 relative to the string line 23 can be measured as a vertical mold distance (VMD) b and a horizontal mold distance (HMD) c between the string line 23 and a predetermined reference point 43 on the mold. Where the mold is a curb and gutter mold, a preferred predetermined reference point 43 on the mold 14 is the intersection of the back of curb (BOC) and the top of curb (TOC).

A cross slope may be established by extending or retracting the slope piston-cylinder mechanism 22. The extension or retraction of slope piston-cylinder mechanism causes rotation of the mold and control sensors around the control string line, illustrated by double pointed dotted lines in FIG. 2.

FIG. 3 illustrates the relationship between the control sensors, string line, and mold once a cross slope $\emptyset$ has been established by extending the slope piston-cylinder mechanism 22. In this instance, the reference point 43 on the mold 14 moves up and to the right in the illustration of FIG. 3, along the arcuate path illustrated in FIG. 2. The magnitude of the movement of the mold caused by inducing a cross slope angle $\emptyset$ can be determined by calculating the distance of movement of the reference point 43 in the horizontal direction d and in the vertical direction e, using the following equations:

$$d=b \sin \emptyset$$

$$e=c \sin \emptyset$$

Extending the slope piston-cylinder mechanism 22 also forces the steer sensor wand 26 away from the string line 23 and the grade sensor wand 28 toward the string line. Movement of these wands in turn initiates corrective movement of the paver and more specifically initiates steering of the paver in the direction of the string line and lowering of the grade piston-cylinder mechanisms. The result of these automatic corrective actions are illustrated by arrows in FIG. 4. The corrective actions move the reference point 43 on the mold 14 horizontally toward the string line 23 as the paver steers into the string line and vertically downward as the grade piston-cylinder mechanisms retract. The overall result of inducing a mold cross slope angle by extending the slope piston-cylinder mechanism 22 is that the vertical mold distance between the string line 23 and the reference point 43 on the mold 14 has increased and the horizontal mold distance between the mold 14 and the string line 23 has decreased. This change in mold position induced by changing the cross slope during paver operations is problematic, as many job specifications include a maximum acceptable position deviation of the finished paved structure that can easily be exceeded when attempting to form a variable cross slope structure using existing paver control systems.

The present invention solves the problems discussed above by providing a control system for a paving apparatus that alters the null positions of the steer and grade sensors to offset the change in mold position caused by transitioning from an initial mold cross slope to an altered mold cross slope during paver travel along the string line. The grade sensor null point is altered in an amount necessary to offset the vertical change in mold position e associated with a given cross slope angle $\emptyset$, which as illustrated by the equation above, is a function of the angle $\emptyset$ and the horizontal mold distance c. The steer sensor null point is altered in an amount necessary to offset the change in horizontal distance d of the mold caused by a given cross slope angle $\emptyset$, which as illustrated by the equations above, is a function of the magnitude of the angle $\emptyset$ and the vertical mold distance b.

Figure 5:
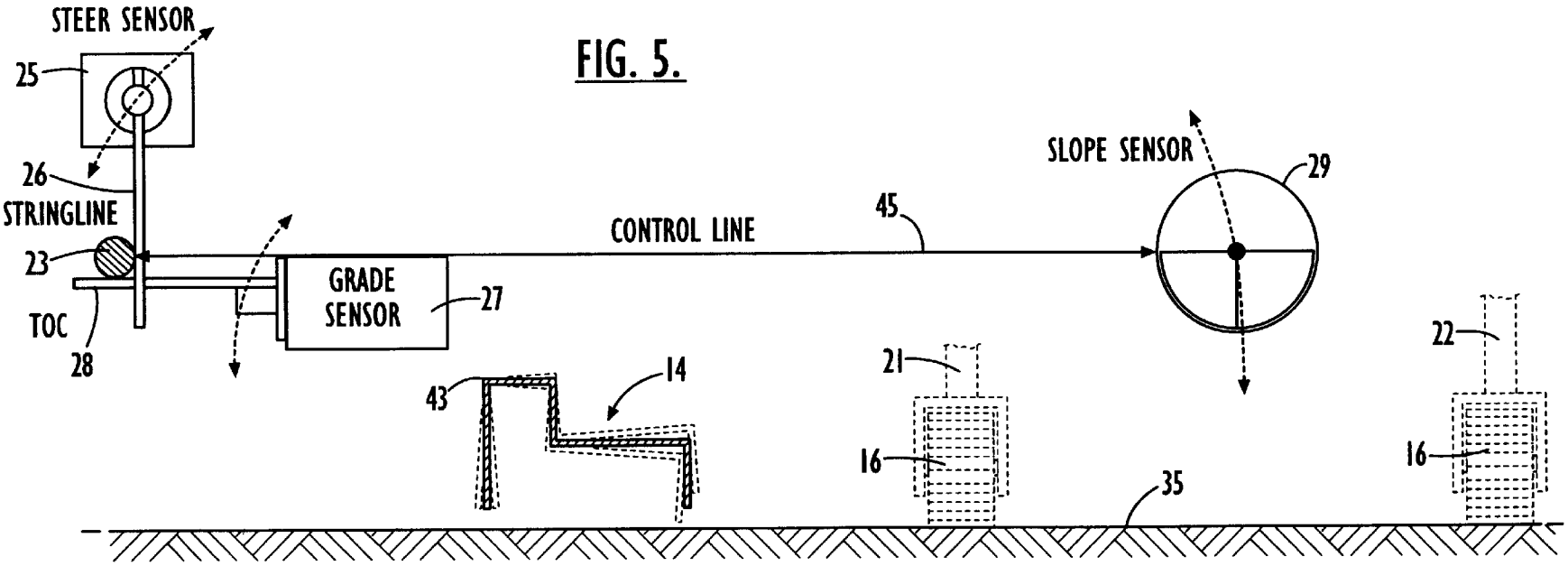
FIG. 5 is a schematic illustration of the relationship between a mold, a string line, and the control system sensors in accordance with the control system of the present invention.

By utilizing the offset compensation feature of the present invention it is therefore possible to automatically adjust grade elevation and steering alignment to keep the predetermined mold reference position 43 true to the string line 23 during transitions to and from a desired mold cross slope during paving operations. The effect of this automatic null position offset feature of the present invention is to effectively move the point about which the mold and control sensors pivot from the string line, as illustrated in FIG. 2, to the mold reference point 43, as illustrated in FIG. 5. Because the steer sensor null position and the grade sensor null positions are automatically offset for a particular mold cross slope angle, the mold reference point 43 remains constant during cross slope operations. The control sensors effectively pivot around the predetermined reference point on the mold, as illustrated by the double pointed arrows in FIG. 5, and the mold 14 effectively pivots about the reference point 43, as illustrated by the dotted mold outlines in FIG. 5.

Figure 6:
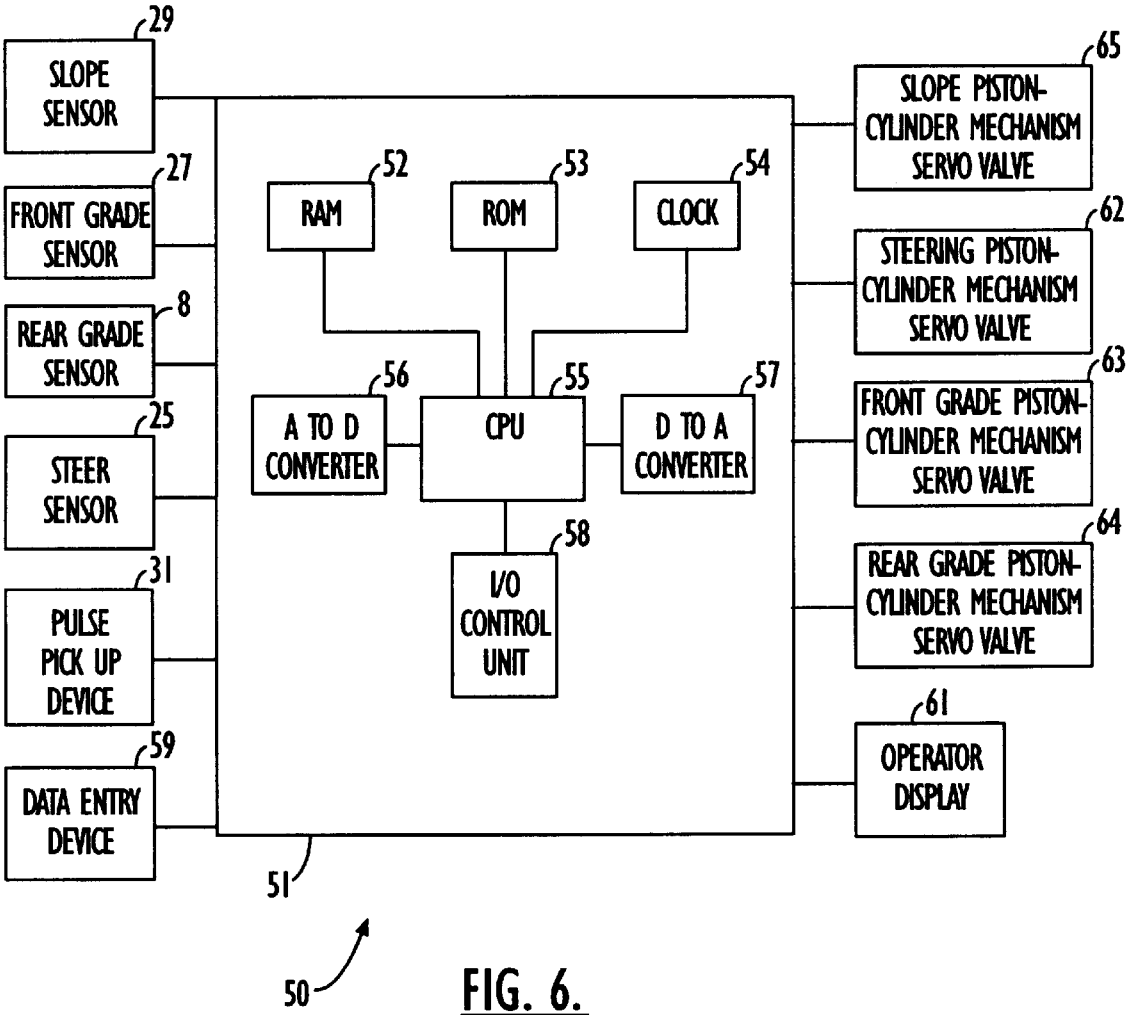
FIG. 6 is a block diagram illustrating the automatic paving apparatus control system according to a preferred embodiment of the present invention.

Turning now to FIG. 6, the r e is shown a block diagram illustrating a paver control system according to a preferred embodiment of the present invention. The paver control system 50 includes a plurality of devices providing input signals to a microcontroller 51, which in turn provides output signals to a plurality of devices. Each of the devices is electrically connected to the microcontroller 51, as is known in the art. A suitable connecting cable for use in the present invention is a three-wire unshielded cable of the type available from Sauer-Sundstrand Company under the MS3102 model number series. The steer sensor 25, grade sensors 27, 8 and slope sensor 29 discussed above provide an input signal to the microcontroller 51 that is proportional to the deflection of their associated sensing wands from their associated null or neutral positions. A pulse pick-up device 31 mounted adjacent to the hydraulic drive motor on a driven ground engaging member 16 provides an input signal to the microcontroller 51 that is used to determine a speed of paver advance as well as a distance of paver travel, which are both easily computable by sensing the revolutions per minute of drive motor rotation and determining the ratio between drive motor rotation and distance of paver travel. Also, a data entry device 59 such as a keypad or keyboard, usually located on the control console 13, provides input data to the microcontroller 51 entered from an operator.

The microcontroller 51 of the present invention includes RAM 52, ROM 53, a clock 54, a central processing unit (CPU) 55, an analog-to-digital converter 56, a digital-to-analog converter 57, and an input-output control unit 58 integral to the microcontroller. Each component is electrically connected to the CPU. Control system program instructions are stored in ROM and executed by the CPU 55, which uses RAM 52 to temporarily store data during microcontroller operations. An integral clock 54 provides a timing reference for the control system and converters 56, 57 are used to convert analog data from the various sensors to digital data for computation of the required offsets, and then back into analog data for the various outputs. It should be understood that, while ROM 53 is illustrated in FIG. 6, those in the art will readily appreciate that program instructions may be stored on other devices, such as, but not limited to, an EPROM. The input output control unit is used to control data moving in and out of the microcontroller 51. A suitable microcontroller for use in the present invention is available from Sauer-Sundstrand Company under the model number S2X, which includes an integral analog-to-digital converter as well integral valve driver electronics.

Those skilled in the art will appreciate that the functions performed by the microcontroller 51 of the present invention may readily be performed by other equivalent electrical devices or circuits, which are intended to be included within the scope of the present invention. For example, in lieu of using a microcontroller 51, a control system 50 may utilize a conventional microprocessor-based personal computer to accomplish functions performed by the microcontroller 51. Additionally, in lieu of using integral processors executing stored program codes, discrete electrical components may be arranged in an electrical circuit to accomplish the same functions as the microcontroller 51, as those in the art will readily appreciate that a circuit comprising discrete electrical components may receive input signals, performed offset calculations, sum the offset value with the sensor voltages, and output the summed value to output devices. These circuits are also included within the scope of the present invention.

The control system 50 also includes a plurality of output devices, including a steering piston-cylinder mechanism servo valve 62 controlling the direction of movement of the steerable ground engaging member 16, a front grade piston-cylinder mechanism servo valve 63 controlling the elevation of the front piston-cylinder mechanism, a rear grade piston-cylinder mechanism servo valve 64 controlling the elevation of the grade piston-cylinder mechanism, and a slope piston-cylinder mechanism servo valve 65 controlling the elevation of the slope piston-cylinder mechanism. Additionally, output data from the microcontroller 51 is sent to an operator display 61, which is typically located on the control console 13. It should be understood that for clarity FIG. 6 illustrates a paver control system having a single steer sensor. In practice, a paver may be equipped with more than one steer sensor and associated piston-cylinder mechanism servo valve. When equipped with multiple steer sensors; however, usually only one is used at a given time.

Figure 7:
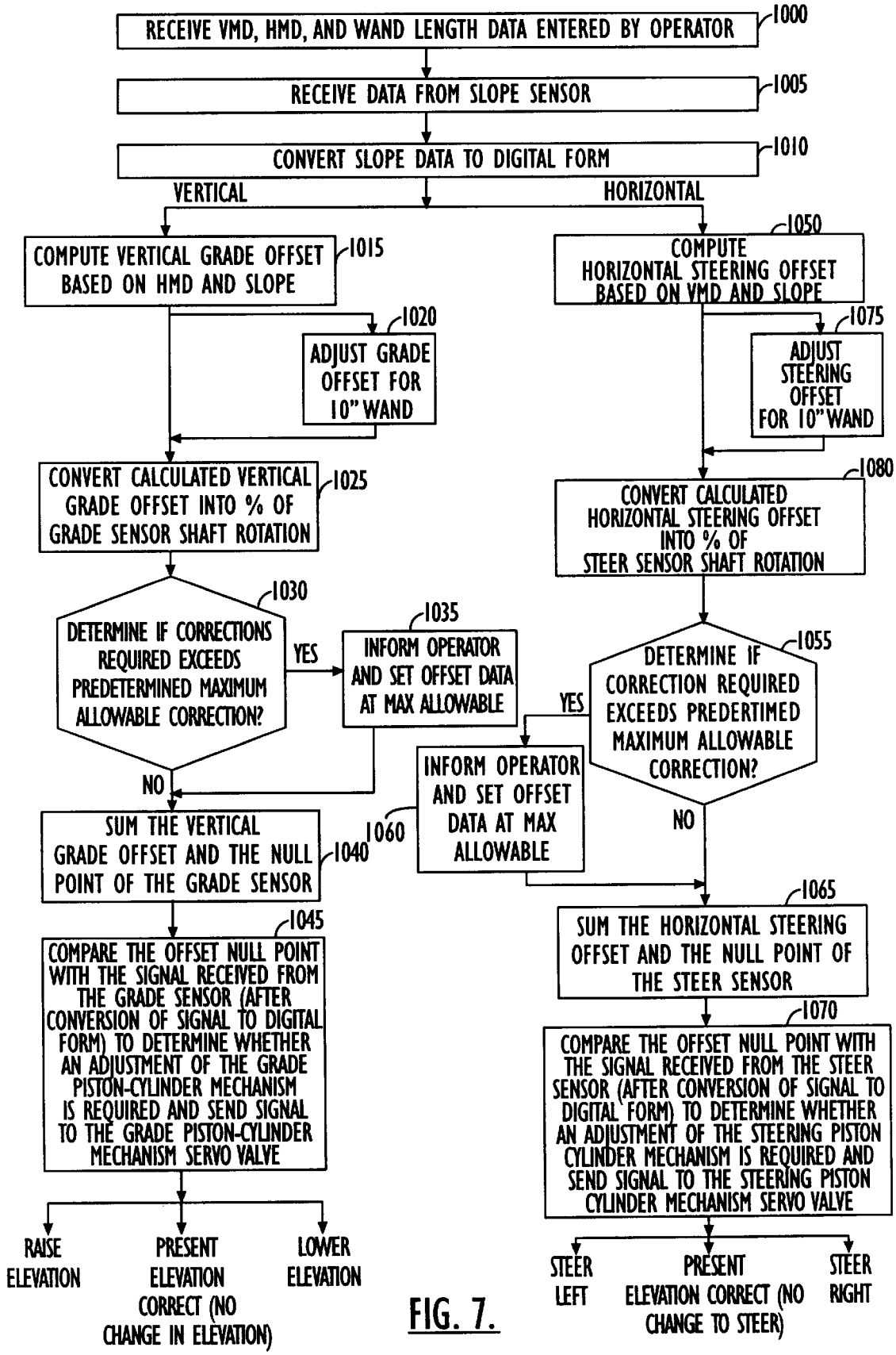
FIG. 7 is a flow chart illustrating the automatic mold cross slope positioning feature according to a preferred embodiment of the control system of the present invention.

FIG. 7 is a flow chart illustrating functions controlled by the microcontroller 51 to implement automatic mold correction according to the present invention. In step 1000, the microcontroller 51 receives vertical mold distance (VMD), horizontal mold distance (HMD) and wand length data entered by an operator using the data entry device 59. As previously mentioned, when the paving apparatus is correctly positioned relative to an external datum or string line, an operator measures HMD and VMD before commencing paving operations. Measuring these parameters and entering them into the control system allows the microcontroller 51 to calculate the horizontal and vertical deviations induced in mold placement by a given cross slope angle. Also as previously mentioned, VMD and HMD are measured from the string line 23 to the predetermined reference point 43 on the mold 14. Wand length data is used by the control system of the present invention and thus there is provision for entering wand length data in step 1000. In practice, successful results have been achieved by using a standard 16 inch steer sensor wand and a standard 6 inch grade sensor wand. Provision is made for using 10" wands, in which case this information would be entered into the control system in step 1000.

In step 1005, the microcontroller 51 receives data from the slope sensor 29. The slope sensor generates an electrical signal proportional to the change in cross slope of the mold relative to a neutral or null position, which is usually a vertical orientation of the pendulum. This slope sensor data is converted by the microcontroller 51 from analog form to digital form in step 1010 to facilitate its use in calculating the vertical and horizontal offsets, which are computed in steps 1015 and 1050, respectively.

The vertical grade offset calculated in step 1015 may be determined in several ways. As previously discussed, the vertical grade offset may be determined using the previously stated equation based on the horizontal mold distance entered by the operator and the cross slope sensed by the slope sensor. Alternatively, the vertical grade offset may be calculated for a plurality of possible cross slope values and stored in a look-up table accessed by the central processing unit.

The vertical grade offset may also determined by dividing the operating range of slope sensor pendulum rotation into a plurality of discrete slope values. A vertical grade offset is calculated for each discrete cross slope value using the previously-stated equation and a simple algorithm is then developed which yields the vertical grade offset calculated for each discrete cross slope value for a given horizontal mold distance. Using a plurality of discrete possible cross slope values and an algorithm to approximate vertical grade offsets for each of the possible cross slope values may facilitate faster processing by the microcontroller than would be achieved by using the actual cross slope value detected by the slope sensor and the previously-stated equation. Successful results have been achieved in the present invention using the MCX104A1018 slope sensor, which has an effective operating range of plus or minus 10% slope, and dividing the ten percent (10%) slope range into 230 discrete possible cross slope values. A vertical grade offset was determined for each of the 230 slope values for a given horizontal mold distance and a simple algorithm was developed that yields the vertical grade offset for each of the discrete cross slope values.

The vertical grade offset determined in step 1015 is converted into a percentage of grade sensor shaft rotation in step 1025. If ten inch sensor wands are used, then the computed vertical grade offset determined in step 1015 is adjusted to correct for use of the ten inch wand in step 1020 before being converted into a percentage of grade sensor shaft rotation in step 1025.

The percentage of grade sensor shaft rotation calculated in step 1025 is used in step 1030 to determine whether, if the required offset correction is made, the result would be to place the grade sensor outside of a predetermined maximum operating range. More particularly, the maximum operating range of the grade and steer sensor shafts is plus or minus 30 degrees of shaft movement. In order to insure that the grade and steer sensors are still within a usable operating range after being offset, corrections are limited to twenty-five percent (25%) of sensor shaft rotation. This limit effectively prevents applying an offset correction that would impair the operation of the grade sensor by offsetting the null position to a point in which the sensor wand cannot effectively rotate and still be within the effective operating range of the sensor. If the determination in step 1030 is that the required correction exceeds the maximum allowable correction, then the operator is notified in step 1035 and the offset data is set at the maximum allowable value.

In step 1040, the control system and more specifically the microcontroller 51 alters the null point of the grade sensor by summing the vertical grade offset value and the null point of the grade sensor. Step 1040 effectively offsets the neutral or null position of the grade sensor for a given cross slope based on a given horizontal mold distance.

Once the null position of the grade sensor has been offset, the microcontroller 51 can then compare the offset null point with the signal received from the grade sensor (after conversion of the grade sensor signal to digital form), determine whether an adjustment of the grade piston-cylinder mechanism is required and send the appropriate signal to the servo valve controlling distribution of hydraulic fluid to the grade piston-cylinder mechanism, as shown in step 1045. The signal sent to the servo valve may either be used to initiate an increase in elevation of the grade piston-cylinder mechanism, maintain the current elevation, or lower the elevation. It should be understood that, while FIG. 7 illustrates a single grade piston-cylinder mechanism, there are typically two such grade piston-cylinder mechanisms on the side of a paving apparatus closest to the string line. If two grade sensors and grade piston-cylinder mechanisms are used, the null point of both grade sensors are offset.

The microcontroller 51 accomplishes offsetting of the steer sensor in much the same way as described above. Converted slope data from step 1010 is used to compute the horizontal steering offset based on the entered vertical mold distance and the slope sensed, as illustrated in step 1050. The calculated horizontal steering offset is converted into a percentage of steer shaft rotation in step 1080 and if ten inch steer sensor wands are used, then the computed horizontal steering offset is adjusted in step 1075. The microcontroller 51 determines if the correction required exceeds the predetermined maximum allowable correction limit in step 1055 and, if so, informs the operator in step 1060 and sets the offset data to the maximum allowable correction. In step 1065, the null point of the steer sensor is altered by summing the null point with the horizontal steering offset value, effectively offsetting the null point. The microcontroller then compares the offset steer sensor null point to the signal received from the steer sensor (after conversion of the voltage to a digital form), determines if adjustment of the paver steering is required and sends the appropriate signal to the servo valve controlling paver steering, which results in either steering the paver to the right, steering the paver to the left, or maintaining the present steering position.

The operations described above are conducted periodically by the microcontroller 51 using the clock 54 as a timing reference. Successful results have been achieved by performing the described operations 200 times per second.

As will be appreciated by those skilled in the art after reading the discussion above, the control system of the present invention advantageously provides for a mold position on a paving apparatus that maintains a relative position true to the string line as the paving apparatus travels along the ground. The present invention may be advantageously utilized to automatically form a paving structure having a variable cross slope relative to the ground upon which the structure is laid. An operator may enter a desired cross slope at any time during operation of the paver and the automatic control system of the present invention will offset the null positions of the steer and grade sensors to insure that the predetermined reference point on the mold position remains constant relative to the string line while the mold transitions between cross slopes.

Another advantageous feature of the present invention is the ability of the control system to transition from an initial mold cross slope to an altered mold cross slope over a given distance. For example, this feature would be advantageous if it is desired to transition from a five percent mold cross slope to a ten percent mold cross slope over a distance of 100 feet. This transition, which utilizes input from the pulse pick-up device on the hydraulic motor of a driven ground engaging member, is also achieved while maintaining a true-to-string line position of the mold.

Figure 8:
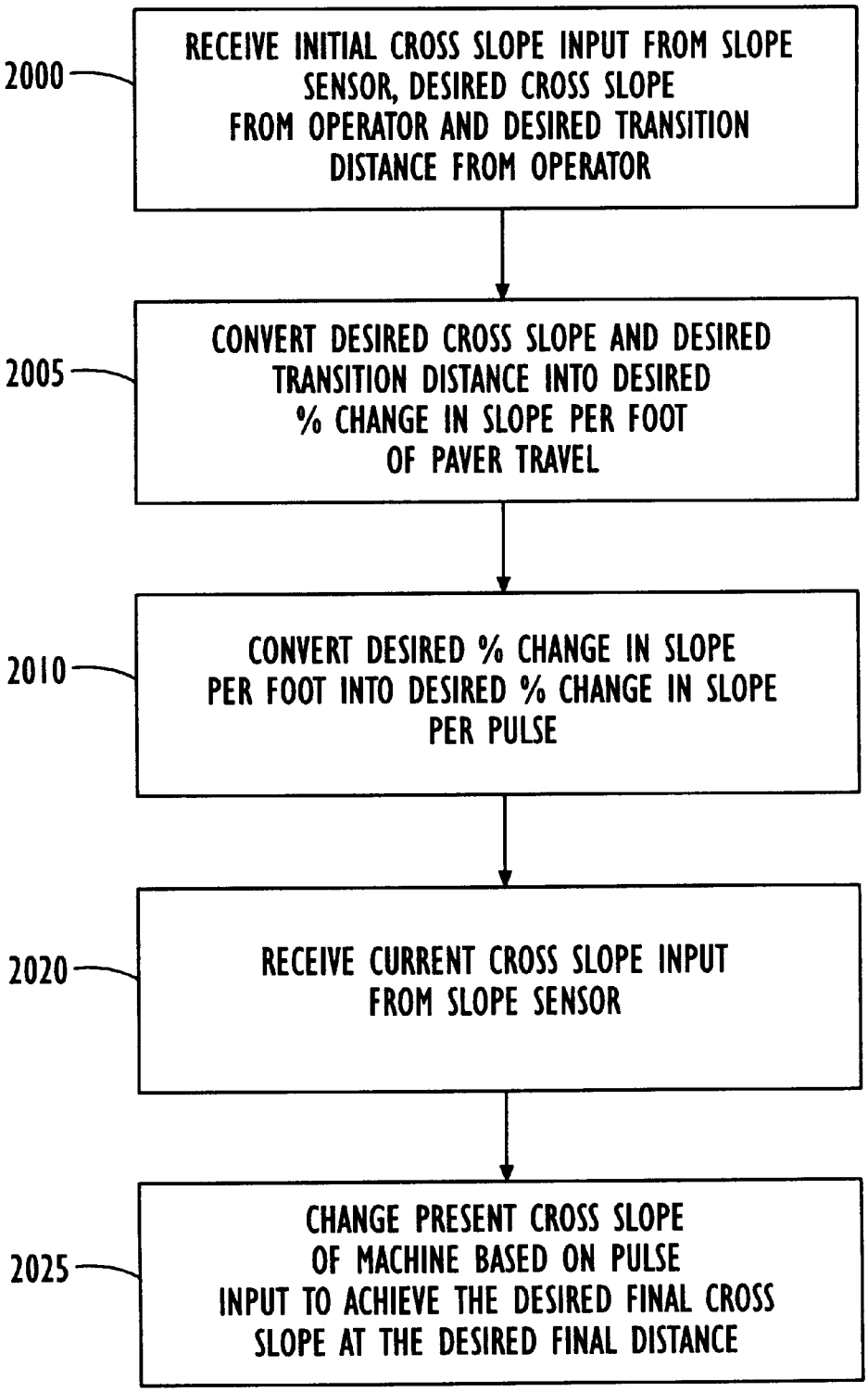
FIG. 8 is a flow chart illustrating the transition to a desired mold cross slope according to a preferred embodiment of the control system of the present invention.

FIG. 8 is a flow chart illustrating the steps performed by the control system and more particularly by the microcontroller 51 in transitioning cross slope over a given distance. In step 2000, the microcontroller 51 receives initial cross slope input from the slope sensor as well as the desired altered cross slope and desired transition distance from an operator using the data entry device 59. The latter values would typically be received as a percentage final slope over a given distance expressed in feet.

The desired altered cross slope and desired transition distance are converted into a desired percent change in cross slope per foot of paver travel by the microcontroller in step

2005. This value is then converted into a desired percent change in cross slope per pulse of the pulse pick-up device in step 2010. This conversion is possible because the distance of paver travel per pulse and therefore the number of pulses per foot of paver travel is known for a given pulse pick-up device.

In step 2020, the microcontroller 51 receives the current cross slope input from the slope sensor 29 and in step 2025, the microcontroller changes the present cross slope of the paving apparatus based on the pulse input received from the pulse pick-up device at a rate necessary to achieve the desired altered cross slope over the desired distance. This process may be periodically performed as the paver travels and successful results have been achieved in the present invention performing the above process 200 times per second. A particular advantage of the control system of the present invention is that an operator may change the desired altered mold cross slope or the desired transition distance at any time during a cross slope transition without affecting the present cross slope of the paving apparatus. During transition, the control system of the present invention is also performing the slope and grade sensor offsets, as previously discussed and illustrated in steps 1005–1080 of FIG. 7, in order to ensure that the predetermined reference point 43 on the mold maintains a substantially constant position relative to the string line 23 during mold cross slope transition.

As demonstrated by the above discussion, the present invention advantageously allows for the automatic molding of continuous paving structures having a variable cross slope without operator action while maintaining the position of the mold substantially constant relative to a string line as the paver travels. The present invention also automatically maintains a substantially constant position of the mold relative to the string line during transition from an initial mold cross slope to an altered mold cross slope over a given transition distance and therefore advantageously automates what heretofore has been a tedious, time consuming, and difficult manual operation.

It will readily be understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise to exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

That which is claimed is:

1. A self-propelled construction apparatus for continuously slip-forming paving material into a predetermined cross-sectional shape on a ground surface having an external datum, comprising:

a frame;

a plurality of ground engaging members including a steerable ground engaging member and at least one driven ground engaging member;

a plurality of posts adjustably supporting said frame on said plurality of ground engaging members for propulsion and steering of said frame thereby, each post of said plurality of posts being extendable and retractable to adjust the position of said frame relative to said ground engaging members;

a slip form mold attached to said frame for depositing and forming paving material onto the ground surface during propulsion of said frame thereover, said slip form mold defining a predetermined reference point and a cross slope transversely relative to the direction of propulsion of said frame, said slip form mold being attached to said frame such that changing the position of said frame also changes the position of said slip form mold;

a paving material distribution system positioned on said frame to continuously distribute paving material to said slip form mold;

a plurality of sensors attached to said frame for detecting changes in the position of said frame relative to the external datum and for generating output signals proportional to the detected changes, each said sensor defining a null point corresponding to a predetermined position of said frame relative to the external datum; and an automatic control system for receiving input signals from said plurality of sensors and for generating output signals for controlling extension and retraction of said plurality of posts and said steerable ground engaging member to control the position of said slip form mold relative to the external datum, said control system being adapted to maintain a substantially constant relative position between the predetermined reference point on said slip form mold and the external datum while changing the cross slope of said slip form mold during propulsion of said frame by altering the null point of at least one sensor of said plurality of sensors.

2. A self-propelled construction apparatus as defined in claim 1 wherein said plurality of sensors includes a steer sensor for continuously detecting and generating an output signal proportional to changes in a horizontal distance of the predetermined reference point on said slip form mold relative to the external datum, a slope sensor for continuously detecting and generating an output signal proportional to changes in the cross slope of said slip form mold, and at least one grade sensor for continuously detecting and generating an output signal proportional to changes in a vertical distance of the predetermined reference point on said slip form mold relative to the external datum.

3. A self-propelled construction apparatus as defined in claim 2 wherein said automatic control system periodically receives an input from said slope sensor and periodically alters the null point of said steer sensor and the null point of said at least one grade sensor while moving said slip form mold from an initial cross slope to an altered cross slope thereof.

4. A self-propelled construction apparatus as defined in claim 3 wherein said automatic control system alters the null point of said at least one grade sensor an amount corresponding to a change in a vertical distance between the predetermined reference point on said slip form mold and the external datum caused by changing the cross slope of said slip form mold from the initial cross slope to a cross slope detected by said slope sensor and altering the null point of the steer sensor an amount corresponding to a change in a horizontal distance between the predetermined reference point on said slip form mold and the external datum caused by changing the cross slope of said slip form mold from the initial cross slope to a cross slope detected by the slope sensor.

5. A self-propelled construction apparatus as defined in claim 1, further comprising:

a hydraulic motor operably connected to at least one ground engaging member of said plurality of ground engaging members for propelling said frame over the ground surface; and a pulse pick-up device in cooperation with said hydraulic motor and electrically connected to said control system, wherein said automatic control system receives an input from said pulse pick-up device to determine a speed and a linear advance of said frame over the ground surface.

6. A self-propelled construction apparatus as defined in claim 5 wherein said automatic control system maintains a substantially constant relative position between the predetermined reference point on said slip form mold and the external datum while changing the cross slope of said slip form mold from an initial cross slope to an altered cross slope over a predetermined distance of travel of said frame over the ground surface.

7. A self-propelled construction apparatus as defined in claim 1, wherein said automatic control system comprises a plurality of servo valves for controlling said steerable ground engaging member and extension and retraction of said plurality of posts.

8. A self-propelled construction apparatus as defined in claim 1 wherein each post of said plurality of posts comprises a piston extendable from and retractable into a cylinder.

9. A self-propelled construction apparatus as defined in claim 1 wherein said control system includes a microcontroller.

10. An automatic control system for changing the cross slope of a mold on a self-propelled paving apparatus from an initial cross slope to a predetermined altered cross slope as the paving apparatus travels over a ground surface in a desired path relative to the external datum, comprising:

at least one grade sensor adapted and positioned to continuously detect deviations in the vertical distance of the predetermined reference point on the mold relative to the external datum and to generate an output signal proportional to the detected deviation, said grade sensor defining a null point corresponding to a predetermined position of the paving apparatus relative to the external datum;

a steer sensor adapted and positioned to continuously detect deviations in the horizontal distance of the predetermined reference point on the mold relative to the external datum and to generate an output signal proportional to the detected deviation, said steer sensor defining a null point corresponding to a predetermined position of the paving apparatus relative to the external datum;

a slope sensor adapted and positioned to continuously detect deviations in the cross slope of the mold as the paving apparatus travels over the ground surface and to generate an output signal proportional to the detected deviation in cross slope, said slope sensor defining a null point corresponding to a predetermined position of the paving apparatus relative to the external datum; and a processor for receiving input signals from said at least one grade, steer, and slope sensors and for generating output signals for steering the paving apparatus and for changing the elevation and cross slope of the mold relative to the external datum, said processor periodically receiving an input from said slope sensor corresponding to the altered cross slope of the mold, determining the change in relative horizontal and vertical distance between the predetermined reference point on the mold and the external datum caused by changing cross slope of the mold from the initial cross slope to the predetermined altered cross slope, altering the null point of said steer sensor an amount corresponding to the determined change in relative horizontal distance caused by changing cross slope of the mold, and altering the null point of said at least one grade sensor an amount corresponding to the determined change in vertical distance caused by changing the cross slope of the mold, thereby maintaining a substantially constant relative position between the predetermined reference point on the mold and the external datum during changes in the cross slope of the mold as the paving apparatus travels over the ground surface.

11. An automatic control system as defined in claim 10, further comprising a pulse pick-up device for generating an output signal proportional to the speed of paver travel over the ground, wherein said processor receives an input from said pulse pick-up device to determine a linear advance of the paving apparatus over the ground surface and maintains a substantially constant relative position between the predetermined reference point on the mold and the external datum while changing the cross slope of said mold from an initial cross slope to a predetermined altered cross slope over a predetermined distance of travel of the paver over the ground surface.

12. An automatic control system as defined in claim 10, wherein said processor receives horizontal mold distance data from an operator and cross slope data from said slope sensor to determine the amount of grade sensor null point alteration and wherein said processor receives vertical mold distance data from an operator and cross slope data from said slope sensor to determine the amount of steer sensor null point alteration.

13. An automatic control system as defined in claim 10, wherein said processor comprises a microcontroller.

14. A method of operating a self-propelled paving apparatus having a paving mold and traveling over a ground surface relative to an external datum using a steer sensor to detect deviations in a horizontal distance between a predetermined reference point on the mold and the external datum and at least one grade sensor to detect deviations in a vertical distance between the predetermined reference point on the mold and the external datum, the steer sensor and at least one grade sensor each defining a null point corresponding to a predetermined position of the mold relative to the external datum, while changing a cross slope of the mold from an initial cross slope to an altered cross slope as the paving apparatus travels over the ground surface, said method comprising the steps of:

continuously detecting the cross slope of the mold as the paving apparatus travels over the ground surface;

periodically determining a change in the horizontal distance between the predetermined reference point on the mold and the external datum caused by changing the mold cross slope from the initial cross slope to the altered cross slope;

periodically determining a change in the vertical distance between the predetermined reference point on the mold and the external datum caused by changing the mold cross slope from the initial cross slope to the altered cross slope;

altering the null point of the at least one grade sensor an amount corresponding to and offsetting the determined change in vertical distance between the predetermined reference point on the mold and the external datum caused by changing the mold cross slope from the initial cross slope to the altered cross slope; and altering the null point of the steer sensor an amount corresponding to and offsetting the determined change in horizontal distance between the predetermined reference point on the mold and the external datum caused by changing the mold cross slope from the initial cross slope to the altered cross slope, thereby maintaining a substantially constant relative position between the predetermined reference point on the mold and the external datum while changing the cross slope of the mold as the paving apparatus travels along a desired path relative to the external datum.

15. A method of operating a self-propelled paving apparatus as defined in claim 14, comprising the additional steps of determining the horizontal mold distance and determining the vertical mold distance, and wherein the amount of grade sensor null point alteration is determined using the horizontal mold distance and the detected cross slope and wherein the amount of steer sensor null point alteration is determined using the vertical mold distance and the detected cross slope.

16. A method of operating a self-propelled paving apparatus as defined in claim 14 wherein each of said steps is performed a plurality of times while changing the cross slope of the mold from the initial cross slope to a predetermined altered cross slope.

17. A method of operating a self-propelled paving apparatus as defined in claim 14 wherein the cross slope of the mold is incrementally changed from the initial cross slope position to the predetermined altered cross slope over a predetermined distance of travel of the paving apparatus over the ground surface, and wherein the change in horizontal distance and the change in vertical distance between the predetermined reference point on the mold and the external datum is determined for each incremental change in cross slope of the mold, and wherein the null point of the at least one steer sensor and the null point of the at least one grade sensor is altered to offset each incremental change determined in the relative horizontal distance and the relative vertical distance between the mold reference point and the external datum, thereby maintaining a substantially constant position of the predetermined mold reference point relative to the external datum while changing the cross slope of the mold from an initial cross slope to a predetermined altered cross slope over a predetermined distance.

* * * * *